United States Patent [19]

Remo

[11] Patent Number: 4,922,827

[45] Date of Patent: May 8, 1990

[54] METHOD AND MEANS FOR INTERCEPTING MISSILES

[75] Inventor: John L. Remo, St. James, N.Y.

[73] Assignee: Quantametrics Inc., St. James, N.Y.

[21] Appl. No.: 286,476

[22] Filed: Dec. 19, 1988

[51] Int. Cl.[5] ..... F42B 13/48

[52] U.S. Cl. ..... 102/496; 102/473; 89/1.11; 244/3.11

[58] Field of Search ..... 102/473, 474, 494–497, 102/505, 506; 244/3.11; 89/1.11

[56] References Cited

U.S. PATENT DOCUMENTS

| | | | |
|---|---|---|---|
| 4,388,869 | 6/1983 | Edelson | 102/494 |
| 4,729,321 | 3/1988 | Stafford | 102/496 |
| 4,781,117 | 11/1988 | Garnett et al. | 102/493 |

FOREIGN PATENT DOCUMENTS

| | | | |
|---|---|---|---|
| 2547405 | 12/1984 | France | 244/3.11 |

OTHER PUBLICATIONS

"Space, Stars, $C_{60}$, and Soot" by H. Kroto Science, vol. 242, 11-25-88, pp. 1139–1145.

*Primary Examiner*—Harold I. Tudor
*Attorney, Agent, or Firm*—Stanger, Michaelson, Reynolds, Spivak & Tobia

[57] ABSTRACT

A ballistic missile about to re-enter the atmosphere is destroyed by explosively dispersing for large quantities of inherently-light $C_{60}$ molecules in clouds in the path of the missile. The sharp edges of the molecules scar the missile and subject it to destruction from the heat or re-entry.

6 Claims, 2 Drawing Sheets

METHOD AND MEANS FOR INTERCEPTING MISSILES

BACKGROUND OF THE INVENTION

This invention relates to defense systems, and particularly to method and means for intercepting missiles, especially ballistic missiles about to re-enter the atmosphere.

One of the problems in defending against ballistic missile attacks has been the difficulty of aiming interceptor missiles to track and strike rapidly approaching ballistic missiles before they come close enough to the target, or even within the target range, so as to destroy the oncoming missile.

OBJECT AND SUMMARY OF THE INVENTION

An object of the invention is to destroy ballistic missiles.

Another object of the invention is to destroy ballistic missiles about to enter the atmosphere on their path to a target.

According to a feature of the invention, these objects are attained, in whole or in part, by dispersing vast quantities of carbon $C_{60}$ molecules in the path of a ballistic missile.

According to another feature of the invention, a canister containing carbon $C_{60}$ molecules holds an explosive in its centre and within the molecules and means to detonate the explosive in response to a signal.

According to another feature of the invention, a launcher launches a missile interceptor containing the canister, guides the interceptor toward the path of the ballistic missile, and detonates the canister in the path of the ballistic missile to form a cloud of $C_{60}$ molecules. The sharp edges of the carbon $C_{60}$ molecules slice and otherwise damage the missile nose-cone or warhead, or other portions of the missile. The harm thus inflicted on the hostile missile prevents its outer surface from protecting its interior as it heats during re-entry into the atmosphere. The heat of re-entry then destroys the missile or at least weakens its destructive capacity.

DESCRIPTION OF PREFERRED EMBODIMENTS

Figure 1:
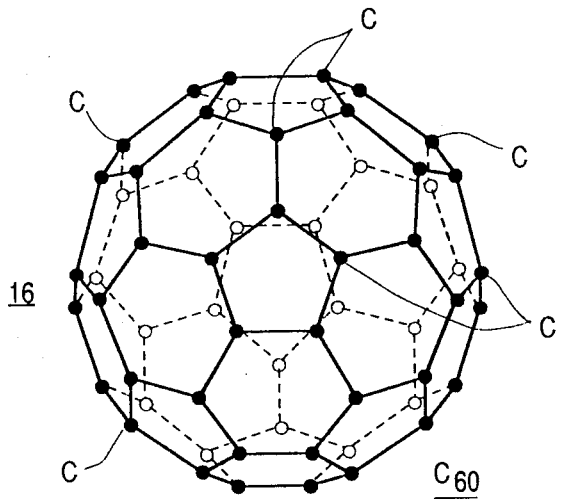
FIG. 1 is an illustration of a carbon 60, or $C_{60}$, molecule.

In FIG. 1, sixty carbon atoms C link with each other to form a nearly spherical molecule $C_{60}$, or carbon 60, having pentagonal and hexagonal faces. The $C_{60}$ molecule has been dubbed "Buckminsterfullerine" and "Fullerine" because of its resemblance to the domes developed by Buckminster Fuller. Because chemical bonds tie each carbon atom firmly to three others, it is stable and extremely difficult to tear apart even with a laser. It also forms sharp edges and is extremely light for its volume. This makes it valuable for defense against re-entry into the atmosphere of hostile ballistic missiles. Such defense is accomplished by by dispersing vast quatities of carbon $-60$ or $C_{60}$ molecules into the path of a ballistic missile.

Figure 2:
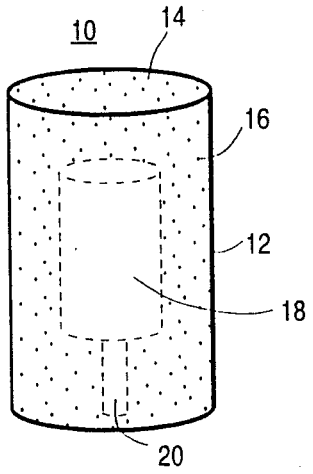
FIG. 2 is a perspective view of a canister containing carbon 60 molecules and an explosive.
Figure 3:
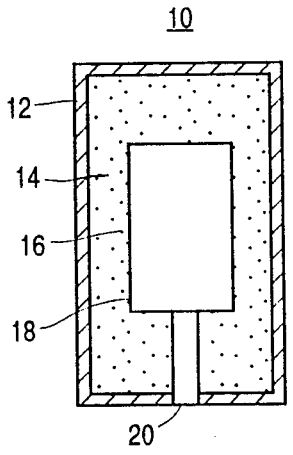
FIG. 3 is a section of the canister in FIG. 2.

According to an aspect of the invention $C_{60}$ molecules fill a cannister 10 containing an explosive as shown for example in FIGS. 2 and 3. Here, a cannister 10 includes a housing 12 that encloses a mass 14 of $C_{60}$ molecules 16 in the form of a powder or a solid bulk. The solid bulk is formed with a material that holds the molecules 16 together or suspends them. An explosive 18 in the center of the cannister housing 12 and inside the mass 14 serves to disperse the molecules 16 widely when an electronically actuated detonator 20 detonates the explosive 18.

Figure 4:
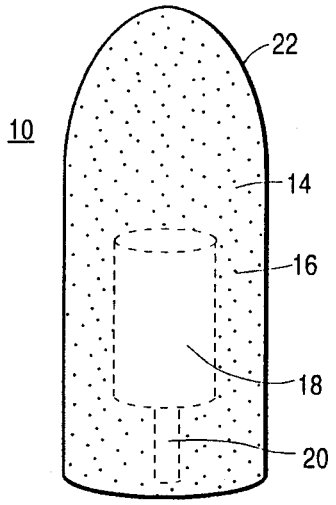
FIG. 4 is a perspective view of another canister containing carbon 60 and an explosive.

According to an aspect of the invention the cannister 10 has an aerodynamic shape. In FIG. 4, an aerodynamically shaped cannister 10 includes a housing an aerodynamically shaped housing 22 but is otherwise identical to the cannister in FIGS. 2 and 3. The housing 22 holds the mass 14 of molecules 16 with the centrally located explosive 18 and the detonator 20.

Figure 5:
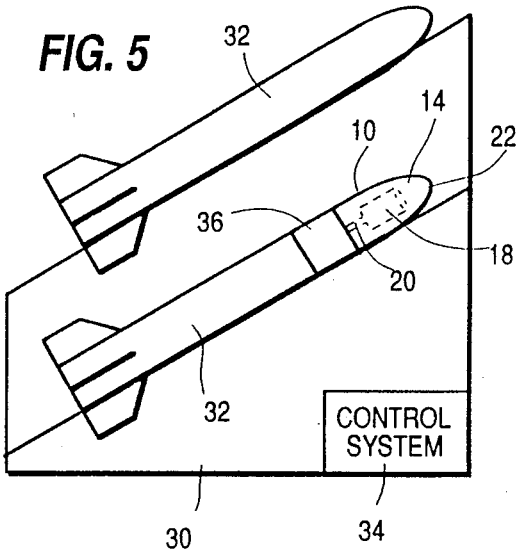
FIG. 5 is a schematic illustration of a launcher system for launching a canister such as that in FIG. 4.

In FIG. 5 a launcher 30 fires a missile interceptor 32 carrying the cannister 10 in its nose. The cannister 10 may be one of the shapes in FIGS. 3 to 5 or any other suitable shape. for simplicity, the cannister of FIG. 4 is illustrated in FIG. 5. An electronic control system 34 in the launcher 30 guides and controls the missile interceptor 32 by communicating with an electronic follower system 36 on board the interceptor 32.

The control system 34 serves to sense the approach of hostile ballistic missiles in space outside the atmosphere, guides the interceptors 32 into the path of the hostile missiles and detonates the detonator 20 in the missile path. This causes the explosive 18 to burst the cannister housing and disperse the $C_{60}$ molecules 14 so as to form a widely-ranging cloud of $C_{60}$ molecules in space in the path of the hostile missiles.

The launcher 30 includes facilities to hold and fire several interceptors 32 as shown in FIG. 5. The control system 34 communicates with each follower system 36 in each interceptor 32. This allows the launcher 30 to guide each interceptor 32 and control the detonation through the follower system 36 aboard each interceptor.

Figure 6:
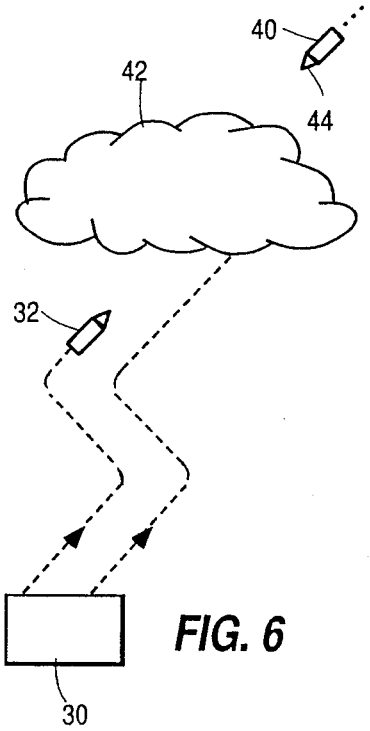
FIG. 6 is a diagram illustrating the operation of the launcher of FIG. 5.

FIG. 6 illustrates the operation of the system of FIG. 5. Here, the launcher 30, on the basis of information which the control system 34 has received either directly or from another station, has launched two interceptors 32. The control system 34 has guided the first interceptor 32 into the path of a hostile ballistic missile 40 in space outside the atmosphere and instructed the follower system 36 on board the interceptor to fire the detonator 20 and initiate explosion of the explosive 18. The latter dispersed the $C_{60}$ molecules 14 to form a cloud 42 of $C_{60}$ molecules in the path of the hostile missile 40. The launcher 30 is guiding the second interceptor 32 into the path of the missile 40 for forming a second cloud of $C_{60}$ molecules.

As the hostile missile 40 passes through the cloud 42 and strikes individual $C_{60}$ molecules, the sharp edges of the very stable carbon $C_{60}$ molecules cut, slice and otherwised damage the missile 40 and its nose cone or warhead 44. The harm inflicted on the missile 40 and its nose cone 44 is sufficient to prevent its outer surface from protecting its interior as it heats upon re-entry into the atmosphere. The heat of re-entry then destroys the missile and its warhead or at least adversely affects its destructive capacity.

The advantage of the use of $C_{60}$ for destroying re-entering missiles is its relatively light weight and stable character. This allows a system to launch vast quantities of the molecules and disperse them into space.

In general, the sharp and hard nature of the $C_{60}$ surface sufficiently damage the missile reentry cone or warhead 44 so that it ultimately self-destructs upon re-entry.

The $C_{60}$ is particularly effective when used in conjunction with a guidance or proximity mechanism such that the canisters of $C_{60}$ are directed before being burst and deployed. The effectiveness of $C_{60}$ is enhanced when used in microprocessor directed patterns and locations most effectively to intercept and damage the missile.

According to another embodiment of the invention, the $C_{60}$ carries a metal atom within the structure itself. This can help in reducing contraction and increasing its strength.

According to another embodiment of the invention, the carbon $C_{60}$ is made into other shapes, such as sheets, spirals or cylinders. According to another embodiment $C_{72}$ and/or other multiples of the hexagonal symmetry are used.

While embodiments of the invention have been described in detail it will be evident to those skilled in the art that the invention may be embodied otherwise without departing from its spirit and scope.

What is claimed is:

1. A shell to be fired at a missile, comprising a mass of material including $C_{60}$ molecules, means for holding said mass of material, and explosive means for dispersing the molecules when the explosive means is detonated.

2. A system for weakening a missile warhead comprising a shell, said shell having a mass of carbon $C_{60}$ material and means for holding said mass of material, said shell having explosive means for dispersing the carbon $C_{60}$ material, a launcher for launching the shell, a control for detonating said explosive after said launcher has launched said shell.

3. A system as in claim 2 wherein said control is arranged to detonate said explosive in the path of the warhead.

4. A system as in claim 3, wherein said control includes guidance means for guiding said shell toward the path of the warhead.

5. A system as in claim 3, wherein said control includes guidance means for guiding said shell toward the path of the warhead and detonate the explosive in the vicinity of said warhead.

6. The method of weakening a missile warhead, which comprises:

launching a shell having a mass of $C_{60}$ material;

guiding the shell into the path of a hostile missile;

and detonating an explosive within the shell so as to disperse the $C_{60}$ material into a large cloud in the path of the missile.

* * * * *